United States Patent [19]

Ng

[11] Patent Number: 4,724,579

[45] Date of Patent: Feb. 16, 1988

[54] HINGE INCLUDING SLOTS AND TABS STRUCTURE

[75] Inventor: W. S. Dominc Ng, Kitchener, Canada

[73] Assignee: Camco Inc., Mississauga, Canada

[21] Appl. No.: 802,729

[22] Filed: Nov. 29, 1985

[30] Foreign Application Priority Data

Nov. 30, 1984 [CA] Canada ..... 469065

[51] Int. Cl.[4] ..... E05D 7/10

[52] U.S. Cl. ..... 16/260; 16/380; 16/268

[58] Field of Search ..... 16/374, 378, 379, 380, 16/260, 265, 268, 271; 160/211; 206/464, 465, 476, 482, 487, 489; 220/22.3, 297, 340, 337, 342

[56] References Cited

U.S. PATENT DOCUMENTS

| | | | |
|---|---|---|---|
| 1,691,468 | 11/1928 | Cooper | 220/337 |
| 2,675,925 | 4/1954 | Skar | 16/268 |
| 2,968,059 | 1/1961 | Munson | 16/268 |
| 2,998,898 | 9/1961 | Gerr | 16/380 |

FOREIGN PATENT DOCUMENTS

| | | | |
|---|---|---|---|
| 287810 | 3/1929 | Canada . | |
| 581354 | 8/1959 | Canada | 16/378 |
| 157210 | 11/1932 | Switzerland | 16/268 |

*Primary Examiner*—Nicholas P. Godici
*Assistant Examiner*—G. M. Reid
*Attorney, Agent, or Firm*—Raymond A. Eckersley

[57] ABSTRACT

A hinge structure is formed by at least two ears projecting from one side edge of a panel with each of the ears being provided with a lobe extending in the same direction from its respective ear and spaced from the edge of the panel to provide an undercut. The ears are adapted to be projected through cooperating slots in a second panel to which the first panel is to be hinged and slid laterally in the slots to position each ear on the opposite side of the second panel and out of alignment with its slot so that a portion of the second panel is received in the undercut or space between the adjacent lobe and the edge of the first panel. A tab moveable from an open position permitting insertion of the ear into one of the slots to a locked position to engage each ear in that one slot and prevent reverse movement of the first panel to move the lobes from behind the second panel is provided to lock the hinge parts together.

3 Claims, 6 Drawing Figures

FIG. 1.
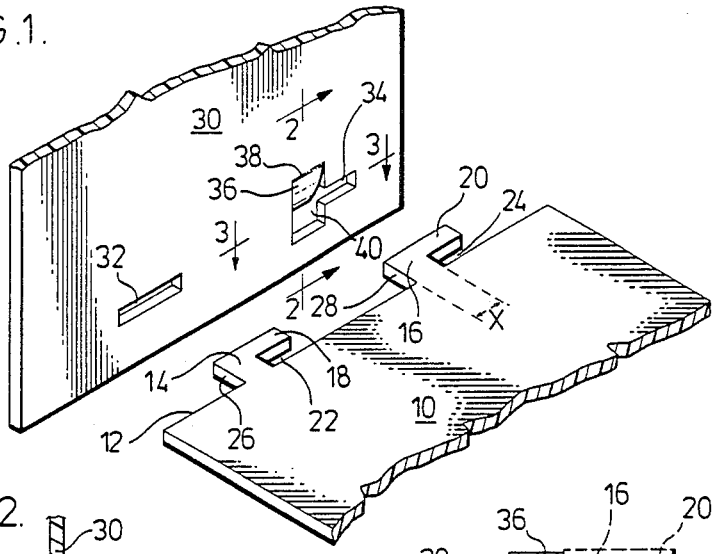
FIG. 2.
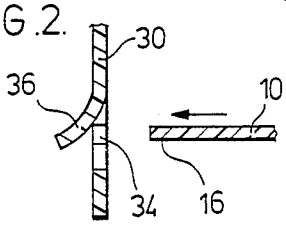
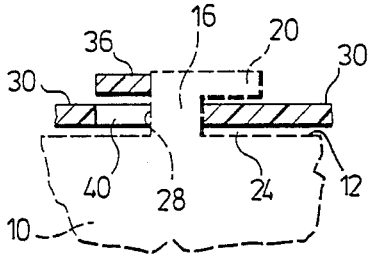
FIG. 3.
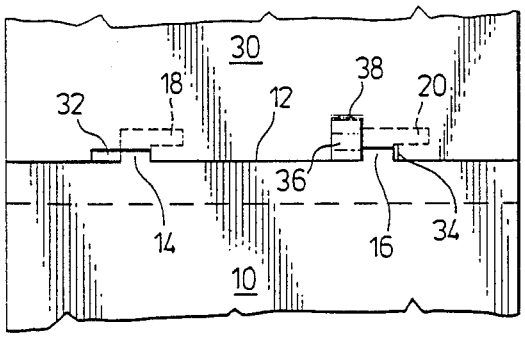
FIG. 4.
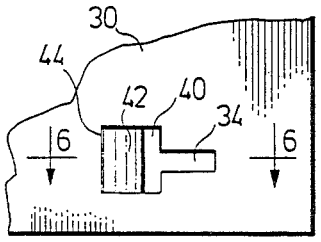
FIG. 5.
FIG. 6.
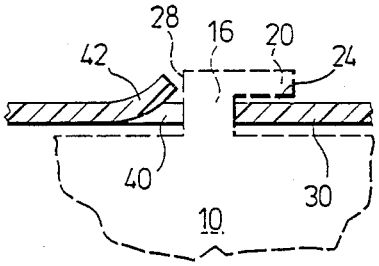

HINGE INCLUDING SLOTS AND TABS STRUCTURE

FIELD OF THE INVENTION

The present invention relates to a hinge structure. More particularly the present invention relates to an economical hinge structure that may be formed directly from the material of the panels to be hinged together, for example, by stamping.

BACKGROUND TO THE PRESENT INVENTION

Various economical pin and socket type hinges have been proposed for use in a variety of different structures or containers or the like wherein one element of the structure is to be pivotted relative to the other. One such device is shown in Canadian Pat. No. 287,810 issued Mar. 12, 1929 to Cooper. In this structure, the pin elements are formed from one of the members and the socket elements from the other. One of the socket elements is physically bendable from an open position permitting insertion of the hinge pin to a closed position locking the hinge pin in position. Such a device provides a relatively inexpensive hinge structure however the forces on the door or panel, particularly when the panel is open, tend to force the bendable socket back to open position and permit the pin to come free.

It is also well known to connect elements together using slots and tabs and to bend the tabs once passed through the slot in order to lock the two members together. Such structure does not permit effective hinging. Usually it is the pin itself that is bent in order to couple the two elements together.

BRIEF DESCRIPTION OF THE PRESENT INVENTION

It is an object of the present invention to provide a relatively inexpensive hinge structure wherein the two elements cooperating to form the hinge are firmly locked in position.

Broadly, the present invention relates to a hinge structure for connecting a pair of members together comprising a first member and a second member; at least two ears projecting from one side edge of said first member, each of said ears having a lobe projecting in the same direction therefrom and spaced from the said edge of said first member to provide an undercut space between each said lobe and said edge; a slot in said second member positioned and sized to receive one of said ears; a second slot in said second member spaced from said first slot and positioned to receive the other of said two ears; a moveable tab means on said second panel moveable from an open position extending said second slot to receive said ear and a closed position locking said second ear in said second slot when said lobes on said ears are positioned on the opposite sides of said second member from said first member and portions of said second member are received within said spaces between said lobes and said edge of said first member.

Preferably the tab means is a unitary element with said second panel i.e., integrally formed from the same sheet of material and is bendable from said open to said closed position on an axis substantially parallel to the longitudinal axis of said slots.

The second of said ears is provided with an abutment face on the side thereof remote from its lobe and said abutment face is substantially perpendicular to said edge of said first member.

The distance between the abutment face and the adjacent edge of the space formed between the lobe on said second ear and said edge of said first panel will be substantially equal to (slightly smaller than) the axial length of said second slot.

BRIEF DESCRIPTION OF THE DRAWINGS

Further features, objects and advantages will be evident from the following detailed description of the preferred embodiments of the present invention taken in conjunction with the accompanying drawings in which:

FIG. 1 is a partial isometric view illustrating two members incorporating the present invention about to be assembled;

FIG. 2 is a section along the line 2—2 of FIG. 1;

FIG. 3 is a section along the line 3—3 of FIG. 1 showing the panels assembled and the tab moved at least part way into a locking position;

FIG. 4 is a plan view of the two members assembled and lying in substantially planar relation;

FIG. 5 shows a modification of the locking means of the present invention; and

FIG. 6 is a section along the line 6–6 of FIG. 5 showing the two elements locked together.

DESCRIPTION OF THE PREFERRED EMBODIMENT

As shown in FIG. 1 a first member 10 which has been shown as a simple planar or panel member but may take any convenient form such as a box shaped door or the like, provided that there is one substantially straight edge such as the edge 12 which in the illustrated arrangement is shown as facing in the axial direction or along the plane of the member 10. The edge may equally well be formed on a section bent, for example, at 90° to that plane of the panel when a box shaped door or the like is to be mounted.

Projecting from the edge 12, i.e., perpendicular to the edge 12, are spaced ears 14 and 16. Each ear has a lobe indicated at 18 and 20 respectively, projecting in the same direction from its respective ear 14 and 16 to provide a space 22 or 24 between the respective lobes 18 and 20 and the edge 12. These spaces 22 and 24 are sufficiently wide to receive the thickness of a portion of the cooperating member adjacent the axial end of the slots into which the ears are to be inserted as will be described hereinbelow.

It will be noted that the ears are each provided on the end thereof remote from the lobes 18 and 20 with abutment edges or faces 26 and 28 respectively (in the illustrated arrangement the ear 14 need not have the abutment edge or face 26, since only the abutment face 28 will be operative).

The lobes 18 and 20 form hinge pins that extend substantially parallel to the edge 12 so that the face of these pins 18 and 20 facing the edge 12 i.e., on the side of the spaces 22 and 24 remote from the edge 12, form hinge surfaces substantially parallel to and spaced from end 12.

The second or cooperating member 30 is provided with a first slot 32. The length of this slot being equal to the length of the ear 14 from the abutment face 26 to the remote end of the lobe 18 so that the ear 14 may be received in the slot 32.

A second slot 34 is also provided in the member 30 in spaced axial alignment with the slot 32. This slot 34 terminates at one end in an opening formed by a moveable tab 36 formed from the member 30 and bendable out of the plane of the member along a fold line 38 that is substantially parallel to the longitudinal axis of the slots 32 and 34. This tab 36 is bendable from an open position as illustrated in FIGS. 1 and 2 to a closed or locking position as illustrated in FIG. 3 or to a fully closed position wherein the tab 36 is substantially in the same plane as the member 30.

The space 40 opens when the tab 36 is in open position extending the axial length of the slot 34 sufficient to accommodate the full length of the ear 16 from the abutment face 28 to the remote end of the hinge pin or lobe 20 while the length of the slot 34 in the longitudinal direction between the end of slot 34 where space 40 commences and the remote end of the slot 34 will be substantially equal to (slightly longer than) the distance X between the abutment face 28 and the adjacent end of the space 24 measured along the edge 12 of member 10.

In the embodiment characterized by FIGS. 1 to 4 the first member 10 is hinged to the second member 30 by inserting the ear 14 into the slot 32 while simultaneously inserting the ear 16 into the slot 34 and space 40 via movement in a direction substantially perpendicular to the side edge 12 of the panel 10 until the hinge pins or lobes 18 and 20 are on the side of the member 30 remote from the remainder of the member 10. In this position the member 10 is then slid laterally to move the hinge pins or lobes 18 and 20 axially into a position behind the rear face of member 30, i.e., portions of the member 30 at the right hand ends of each of the slots 32 and 34 are received within the spaces 22 and 24 as shown for example for the ear 16 in FIG. 3.

In FIG. 3 the tab 36 has been shown partially folded back into the aperture 40 but in any event folded back sufficiently so that the abutment edge 28 will contact the adjacent edge of the tab 36 if there is any movement tending to slide the pin 20 from behind the member 30, i.e., in a direction to the left in FIG. 3. It will be apparent that this locks the hinge structure together and prohibits any such lateral movement of the member 10 thereby holding not just the pin 20 in position but also the pin 18 and if any similar pin and slot connections are used they will also be retained in position by a single tab 36. Obviously if desired, tabs may be used on each of the receiving slots and each could be constructed in the manner described above with respect to the slot 34 and opening 40.

A modification of the invention is shown in FIG. 5 and 6 the difference being that the tab 36 has been replaced by a tab 42 hinged to the panel or member 30 by a hinge or bend line 44 which is substantially perpendicular to the longitudinal axis of the slots 32 and 34, i.e., it is in effect perpendicular to the fold or hinge line 38 of the first embodiment. If desired tab 42 may be deflected by the ear, say ear 16 (as the tab 36 could also have been deflected in the previous embodiment) as the ear 16 enters the slot and extension opening 40 formed where the tab 42 is bent out of the plane of the member 30. Once the pins 18 and 20 are in position, for example as illustrated in the FIG. 6 embodiment, the tab 42 may be bent back or may spring back sufficiently to the position illustrated in FIG. 6 to prevent removal of the ears 14 and 16 from their respective slots 32 and 34.

With the spring back arrangement it may be that subsequent manual deflection of the tab will be unnecessary however a more positive lock is provided when the tab 36 is moved back into the plane of the member 30 since forces tending to remove the ear 14 and 16 from their slots 32 and 34 must then directly compress the tab 36, i.e., the tab 36 must be sheared in order to permit such lateral movement.

In both the embodiments described above the tab 36 or 42 need only be deflected about its hinge line 38 or 44 if the ears 14 and 16 are to be removed from their slots. It will be apparent that in each of the embodiments the length of the slot 34 will normally be substantially equal to the length X while the degree of extension of the slot 34 by the opening 40 must be sufficient to accommodate the axial length of the lobe or hinge pin 20.

In the illustrations the tabs 36 and 42 have been shown covering substantially the whole area of the opening 40 but it will be apparent that if the hinge is formed by stamping, as normally will be the case, the opening 40 will be slightly larger on the sides and ends to accommodate the material that will be stamped out to form the tab 36 or 42 in the opening 40. In any event the tab 36 or 40 when in locked position will prevent retraction of the ear 16 by engagement with the abutment face 28.

Having described the invention modifications will be evident to those skilled in the art without departing from the spirit of the invention as defined in the appended claims.

What I claim as new and desire to secure by Letters Patent of the United States is:

1. A hinge structure comprising:

a first member having an elongated substantially straight edge, at least a first and a second ear projecting from the edge, each of the ears having a lobe projecting generally perpendicular to said ear and each lobe positioned on the side of each ear facing in the same direction, each said lobe forming a hinge pin and defining one side of a space between the hinge pin and the edge;

a second member including first and second slots adapted to receive the respective lobes of the first and second ears therethrough when the first and second members are positioned substantially perpendicular to each other and the first member is moved toward the second member;

the second slot having an extended opening for receiving the second ear, the first and second ears being movable in a direction parallel to the hinge axis before a locking tab means is in a locking closed position within their respective first and second slots into a hinging position to locate portions of the second member in the spaces between the lobes of the first and second members and the lateral edge of the first member, in the hinging position the second ear being positioned in the second slot substantially clear of the extended opening of the second slot; and, the second member includes said locking tab means which is integral with said second member and adjacent the extended opening of the second slot, the locking tab means being movable from an open position allowing the second ear to be inserted into the second slot to said locking closed position, when the ears have been moved in a direction parallel to the hinge axis in the slots into the hinging position, closing the extended opening of the second slot and locking the second ear in the second slot, the tab means engaging an abutment end face on the second ear remote from its lobe when in the locking closed position to prevent movement of the ears to retract the lobes through the slots.

2. A hinge structure as defined in claim 1 wherein said locking tab means is generally movable about an axis extending substantially parallel to the longitudinal axis of said slots.

3. A hinge structure as defined in claim 1 wherein said locking tab means is generally movable about an axis substantially perpendicular to the longitudinal axis of said slots.

* * * * *